United States Patent [19]

Ausherman

[11] 4,452,448

[45] Jun. 5, 1984

[54] EXERCISING MACHINE

[76] Inventor: Harry S. Ausherman, 715 Fairway, Wichita, Kans. 67212

[21] Appl. No.: 354,942

[22] Filed: Mar. 5, 1982

[51] Int. Cl.[3] ..... A63B 69/06

[52] U.S. Cl. ..... 272/131; 272/72

[58] Field of Search ..... 272/72, 129, 131, DIG. 4, 272/144

[56] References Cited

U.S. PATENT DOCUMENTS

| | | | |
|---|---|---|---|
| 2,251,120 | 7/1941 | Davis | 272/72 |
| 2,278,591 | 4/1942 | Sak | 272/72 |
| 2,307,856 | 1/1943 | Porter | 272/131 |
| 2,714,507 | 8/1955 | Goodrich | 272/72 |
| 3,904,196 | 9/1975 | Berlin | 272/72 |

FOREIGN PATENT DOCUMENTS

| | | | |
|---|---|---|---|
| 2347029 | 3/1974 | Fed. Rep. of Germany | 272/72 |

*Primary Examiner*—Richard J. Apley
*Assistant Examiner*—Chris Coppens
*Attorney, Agent, or Firm*—John H. Widdowson

[57] ABSTRACT

An exercising machine having a frame including a pair of side members and a seat slidably resting upon the side members. A brake shaft attached to the frame. A friction producer slidably engages around the brake shaft. A member for reciprocating the seat on the rails while simultaneously reciprocating the friction producer along the brake shaft when physically operated by the user of the exercising machine.

2 Claims, 7 Drawing Figures

FIG. 1
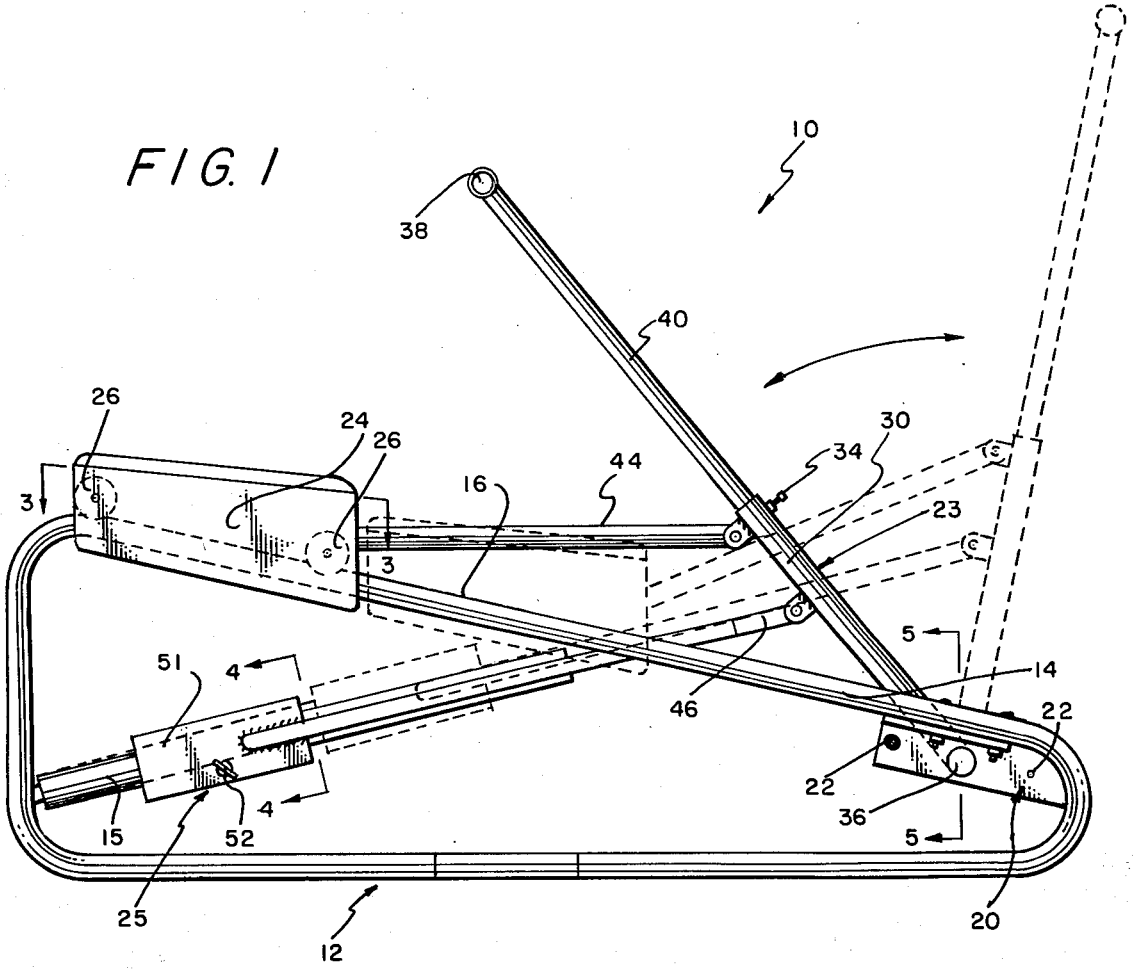
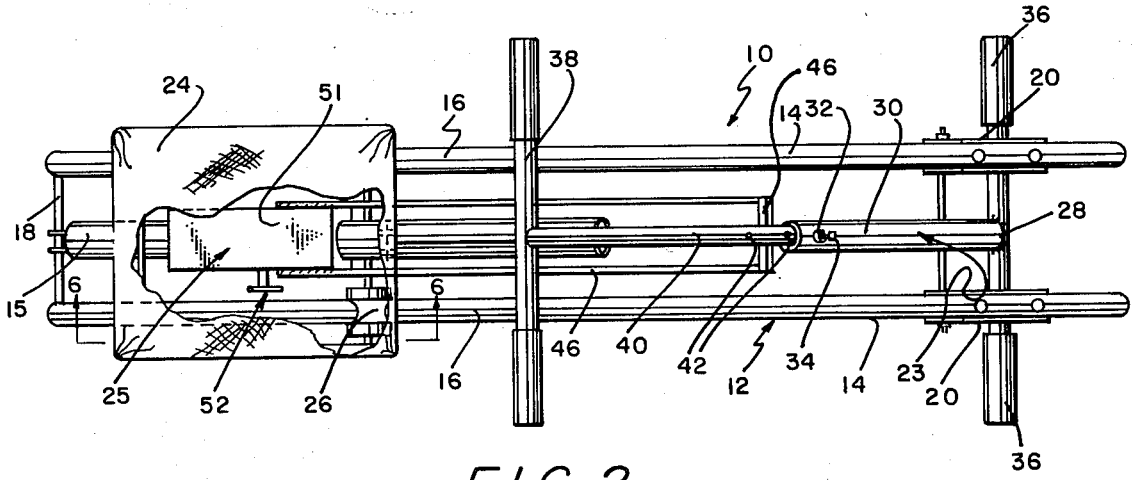
FIG. 2

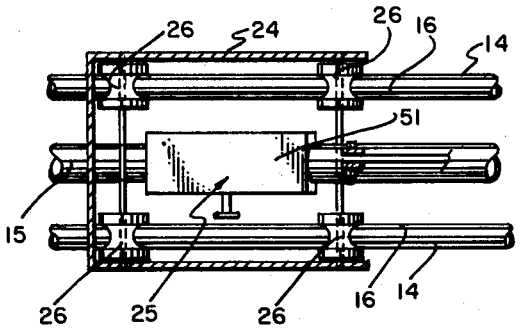
FIG. 3
FIG. 4
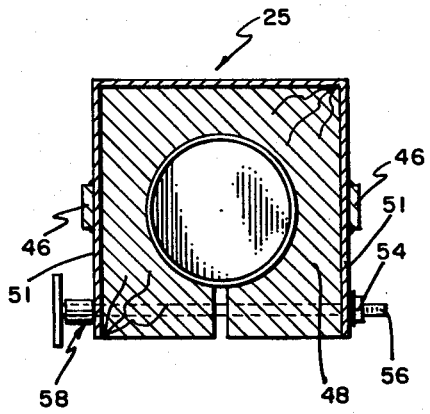
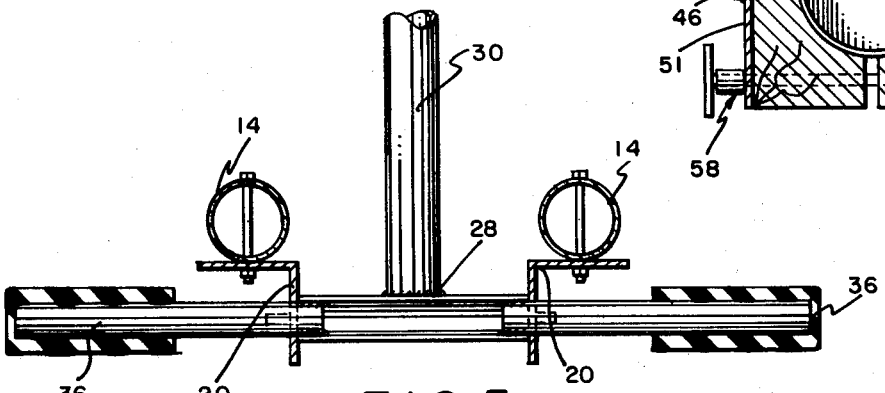
FIG. 5
FIG. 7
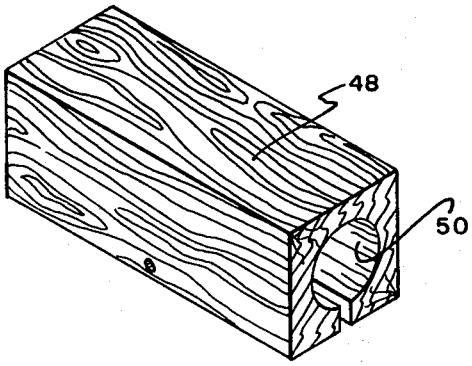
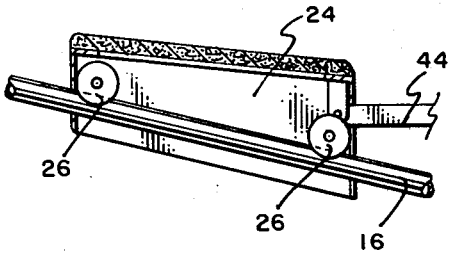
FIG. 6

EXERCISING MACHINE

BACKGROUND OF THE INVENTION

1. Field of the Invention

This invention provides an exercising machine. More specifically, this invention contemplates a novel exercising machine which uses the user's weight, and a wooden shoe wears frictionally against a stationary shaft to provide the friction against which the user works in exercising.

2. Description of the Prior Art

U.S. Pat. No. 2,125,443 by Begley illustrates wood friction elements engaging a spherical surface. U.S. Pat. Nos. 4,007,927, 4,060,241 and 4,071,235 by Proctor, Hegel and Fout, respectively, disclose a friction material which is not wood. None of the foregoing prior art teaches or suggests the particular exercising machine of this invention which utilizes a wooden shoe means which slidably engages a stationary shaft to provide resistance against which the user of the exercising machine operates.

SUMMARY OF THE INVENTION

This invention accomplishes its desired objects by providing a novel exercising machine comprised of a frame having a pair of side members situated parallelly with respect to each other and whose tops provide a pair of rails. A seat member slidably rests upon the rails of the side members. A brake shaft member attaches to the frame, and a friction producing means slidably engages around the brake shaft means. A means unconnected to the frame for reciprocating the seat means on the rails of the side members while simultaneously reciprocating the friction producing means along the brake shaft means when physically operated by the user of the exercising machine.

It is an object of the invention to provide a novel exercising machine which is capable of being easily and inexpensively manufactured.

Still further objects of the invention reside in the provision of an exercising machine which can be easily transported and operated.

These, together with the various ancillary objects and features which will become apparent as the following description proceeds, are attained by this invention, preferred embodiments being shown in the accompanying drawings by way of example only, wherein:

BRIEF DESCRIPTION OF THE DRAWINGS

FIG. 1 is a side elevational view of the exercising machine with dotted lines representing various positions of operation;

FIG. 2 is a top plan view of the invention;

FIG. 3 is a horizontal sectional view taken in direction of the arrows and along the plane of line 3—3 in FIG. 1;

FIG. 4 is a vertical sectional view taken in direction of the arrows and along the plane of line 4—4 in FIG. 1;

FIG. 5 is a vertical sectional view taken in direction of the arrows and along the plane of line 5—5 in FIG. 1;

FIG. 6 is a vertical sectional view taken in direction of the arrows and along the plane of line 6—6 in FIG. 2; and FIG. 7 is a perspective view of the wood block which is one of the frictional elements of the invention against which the user must operate.

DETAILED DESCRIPTION OF THE INVENTION

Referring in detail now to the drawings, wherein similar parts of the invention are identified by like reference numerals, there is seen the exercising machine, generally illustrated as 10, having a frame, generally illustrated as 12, including a pair of side members 14—14 which are situated parallely with respect to each other and whose tops provide a pair of rails 16—16.

A cross brace member 18 interconnects the side members 14—14. A brake shaft 15 has an end bound to the brace member 18 and protrudes aslantly therefrom. A pair of bracket members 20—20 connect to the side members 14—14 and as shown in FIGS. 1 and 2, are opposed to each other. Each bracket 20 has a plurality of apertures 22 which are in registry. A means, generally illustrated as 23, for simultaneously reciprocating a seat 24, which is supported on the rails 16—16 by wheels 26—26—26—26, and a friction producing means 25, which slidably engages around the brake shaft 15, pivotably lodges within a pair of opposed registered bracket apertures 22—22 of the pair of bracket members 20—20.

Means 23 is generally defined by a generally T-shaped member 28 having a conduit aperture 32 wherethrough a bolt 34 passes. A pair of footrests 36—36 (see FIGS. 1 and 5) is threadably received by the T-shaped member 28 and protrudes outside bracket members 20—20.

A handlebar 38 includes a rod 40 integrally bound thereto which is telescopically disposed within the conduit 30. The rod 40 has a plurality of rod apertures 43 (see FIG. 2) which can be telescopically aligned with the conduit aperture 32 (and to the bolt 36) in order to adjust the height of the handlebar 38 with respect to the conduit 30 and the user of the exercising machine 10. Likewise, the T-shaped member 28 and the threadably received footrests 36—36 may be pivotally adjusted through any of the registered bracket apertures 22—22 for the height and length of legs of the user.

A seat moving bar 44 interconnects the seat 24 to the conduit 30. A pair of friction producing rods 46—46 interconnects between the friction producing means 25 and the conduit 30. In a preferred embodiment of the invention, friction producing means 25 comprises a wooden block 48 encased in a metal container 51 and by an opening 50 through which the brake shaft 15 extends in order for the wooden block 48 to reciprocally traverse the shaft 15 simultaneously to and in the same direction to the seat 24 being reciprocated when the user sits on the seat 24 and physically operates the exercising machine 10 by grasping the handlebar 38 and pivoting the same back and forth. A tension adjusting means, generally illustrated as 52, engages the wooden block 48 as shown in FIG. 4 for adjusting the frictional tension of the wooden block 48 against the shaft 15. Preferably, tension adjusting means 52 is a nut 54 and bolt 56. The user of the exercising machine 10 works against the friction created by the wooden block 48 against the brake shaft 15.

With continuing reference to the drawings for operation of the invention, the user of the exercising machine 10 should first adjust the machine 10 for the user's height. The height of the handlebar 38 is adjusted by inserting bolt 34 through conduit aperture 32 and into one of the rod apertures 42.

The lower aperture 42 (see FIGS. 1 and 2) is in position for a short person. The middle aperture 42 is for an average height person and the upper aperture 42 is for a tall person or one with long arms. There are also three positions for the footrests 36—36. FIGS. 1 and 2 illustrate the footrests 36—36 threadably engaged into T-shaped member 28 through the middle aperture 22 for a person of average height. The forward aperture 22 is for a tall person (or one with long legs) and the back aperture 22 is for a short person (or one with short legs).

After the handlebar 38 and the footrests 36—36 have been adjusted for the height of the user, tension adjusting means 52 should be adjusted in accordance with the strength of the user and the weight of the user. Clockwise rotation of the bolt 56 tightens the frictional tension of the wooden block 48 against the brake shaft 15, against which the user must work. Counterclockwise rotation of the bolt 56 loosens the frictional tension of the wooden block 48 and should be employed by heavy or weak users. When the user sits on the seat 24 and grasps the handlebar 38, pivotation of the handlebar 38 forward and backward reciprocates the user sitting on the seat 24 resting on the racks 16—16 of the side members 14—14 while simultaneously reciprocating (in the same direction as the user on the seat 24) the wooden block 48 along the brake shaft 15. By adjusting the tension of the wooden block 48 against the shaft 15 in accordance with the strength and weight of the user and by frequent povitation of the handlebar 38, the user can obtain the exercise needed to stay physically in shape.

While the present invention has been described herein with reference to particular embodiments thereof, a latitude of modifications are intended in the foregoing disclosure and it will be appreciated that in some instances some features of the invention will be employed without a corresponding use of other features without departing from the scope of the invention as set forth.

I claim:

1. An exercising machine comprising a frame having a pair of side members situated parallelly with respect to each other and whose tops provide a pair of rails; a seat means slidably resting upon said rails of the side members; a brake shaft means attached to said frame; a friction producing means slidably engaging around said brake shaft means; and a means attached to said frame for reciprocating the seat means on the rails of the side members while simultaneously reciprocating the friction producing means along the brake shaft means when physically operated by the user of the exercising machine, said exercising machine additionally comprising a seat moving bar interconnecting the seat means with the means for simultaneously reciprocating the seat means and the friction producing means along the brake shaft means; said exercising machine additionally comprising a pair of bracket members attached to said pair of side members and opposed with respect to each other, said pair of opposed bracket members each including a structure defining a plurality of bracket apertures, said opposed bracket apertures of opposed bracket members being in registry; said means for simultaneously reciprocating the seat means and the friction producing means pivotally lodges within a pair of opposed registered bracket apertures of said pair of bracket members; said means for simultaneously reciprocating includes a structure which partially defines a conduit with at least one conduit aperture; said exercising machine additionally comprising a handlebar including a rod integrally bound thereto and which is telescopically disposed within said conduit, said rod having a plurality of rod apertures which can be telescopically aligned with the conduit aperture in order to adjust the height of said handlebar with respect to the conduit; said exercising machine additionally comprises a cross brace member interconnecting said pair of side members of said frame, said brake shaft means has an end bound to the cross brace member and protrudes aslantly therefrom; said friction producing means comprises a wooden block means including an opening through which said brake shaft means extends in order for the wooden block means to reciprocally traverse the brake shaft means simultaneously to and in the same direction to the seat means being reciprocated; said exercising machine additionally comprising a tension adjusting means engaging the wooden block means for adjusting frictional tension of the wooden block means against the brake shaft means.

2. The exercising machine of claim 1 additionally comprising a metal container encasing said wooden block means; a pair of friction producing rods interconnected between the combined metal container-wooden block means and the conduit; and a pair of footrests which are threadably received by the means for reciprocating and protruding therefrom while pivotally lodging within a pair of opposed registered bracket apertures of said pair of bracket members.

* * * * *